United States Patent [19]

Kenny

[11] Patent Number: 4,799,829

[45] Date of Patent: Jan. 24, 1989

[54] METHOD AND APPARATUS FOR REMOVING SUBMERGED PLATFORMS

[76] Inventor: Patrick M. Kenny, 105 Eve St., Belle Chassee, La. 70037

[21] Appl. No.: 920,021

[22] Filed: Oct. 17, 1986

[51] Int. Cl.[4] ..... E02D 9/00; E21B 29/02; B23D 21/00; B26D 3/16

[52] U.S. Cl. ..... 405/195; 405/232; 166/55; 166/297; 30/92

[58] Field of Search ..... 405/195, 224, 227; 166/55, 55.1, 55.7, 63, 297, 298, 299; 30/92, 103; 52/514

[56] References Cited

U.S. PATENT DOCUMENTS

| | | | |
|---|---|---|---|
| 2,884,066 | 4/1959 | Teplitz et al. | 166/55 |
| 3,224,204 | 12/1965 | Siebenhausen | 405/227 |
| 4,043,389 | 8/1977 | Cobb | 166/55 |
| 4,158,388 | 6/1979 | Owen et al. | 166/298 X |
| 4,298,063 | 11/1981 | Regalbuto et al. | 166/55 |
| 4,352,397 | 10/1982 | Christopher | 166/55 X |
| 4,598,769 | 7/1986 | Robertson | 166/55 |
| 4,619,318 | 10/1986 | Terrell et al. | 166/55 |

*Primary Examiner*—Randolph A. Reese

*Assistant Examiner*—John A. Ricci

[57] ABSTRACT

Disclosed is a method and apparatus for cutting piling and conductors extending into the sea floor from an offshore platform. A window is cut into the piling to permit access to the stabbing point which is then removed. The piling is washed out to remove sand and mud at least to the depth where the cut is to be made. A cutter/pinning device is lowered to the disired elevation of cut. Once the cutter/pinning device is properly positioned, engaging pistons are driven radially outward from the cutter/pinning device to engage the walls of the piling, preferably both above and below the line of cut. A series of radially disposed torches or explosives within the cutter/pinning device are then ignited to burn or blow a circumferential cut in the piling at the desired elevation of cut which will typically be twenty feet below the mud line. The support cable or tubing used to lower the cutter/pinning device is then withdrawn from the piling leaving the cutter/pinning device behind still engaging the piling both above and below the line of cut, thereby ensuring structural stability of the piling until it is desired to disassemble and remove the offshore platform.

12 Claims, 3 Drawing Sheets

METHOD AND APPARATUS FOR REMOVING SUBMERGED PLATFORMS

BACKGROUND OF THE INVENTION 1. FIELD OF THE INVENTION

The present invention relates generally to offshore platforms and more particularly, to a method and apparatus for cutting the pilings and conduits from an offshore structure below the mud line. 2. BRIEF DESCRIPTION OF THE PRIOR ART Typically, when an offshore platform has been removed, explosives have been used. When an offshore platform is to be removed, it is a requirement that the pilings be cut off twenty feet below the mud line. This has been routinely accomplished by cutting into the pilings above the water line, jetting out the piling to make sure that a clear path is available to a depth of twenty feet below the mud line and then lowering an explosive to that point.

For environmental reasons, a recent ruling by the Mineral Management Service of the Department of Interior has banned the use of explosives for this purpose. The use of explosives is considered to be hazardous to marine life.

After the piling has been sheared by the explosions, the platform is cut in sections and hauled away by a derrick barge. Usually, it is necessary for the derrick barge to be present during the entire operation.

SUMMARY OF THE INVENTION

It is therefore an object of the present invention to provide a method and apparatus for cutting or burning the piling of an offshore platform at a point twenty feet below the mud line.

It is a further object of the present invention to provide an apparatus and method for maintaining stability of the platform after the cuts have been made twenty feet below the mud line.

Yet another object of the present invention is to provide pile pinning means above and below the line of cut to maintain platform stability until it is to be hauled off.

Still another object of the present invention is to provide a pinning means which is releaseable when the platform is ready to be removed.

Yet another object of the present invention is to provide a method and apparatus for cutting pilings and conductors twenty feet below the mud line which is inherently safe to sea life.

Briefly stated, the foregoing and numerous other features, objects and advantages of the present invention will become readily apparent upon reading the detailed description, claims and drawings set forth hereinafter. These features, objects and advantages are accomplished through the use of a cutting tool which can be lowered through piling, conductor piping and the like to the desired level to effect a cut of such piling, conductor piping or the like at the desired level without the use of any explosive type forces.

In order to cut the piling of an offshore platform at twenty feet below the mud line, it is necessary to first gain entrance to each pile. Typically, this is accomplished at what is commonly referred to as the plus-12 level or plus-16 level of the platform, or cellar deck, such levels representing 12 and 16 feet respectively above the sea level, by removing the deck section of the platform using a derrick barge, this allowing entrance to the pile interior. It is at that point that there are stabbing points or guide cones in the structure which serve to align the upper part of the structure (deck) when it is set in place on pilings previously driven through templates in the platform section into the sea floor, anchoring the platform. In the method of the present invention, these stabbing points or guide cones provide obstructions in each individual pile which also must be removed in order that the tool of the present invention can be lowered therethrough. Therefore, a window is cut at the plus-12 (or cellar deck) level in the pile allowing access to the cone or stabbing point. Having gained access to the cone or stabbing point, it is cut out and removed. The tool of the present invention is then lowered, typically from the top deck of the platform, through the pile. It may first be necessary to jet out any mud or sand within the pile in order to ensure that the tool can be lowered to a level twenty feet below the mud line. Once the tool is lowered to the desired elevation, piston-like slips are activated to engage the side walls of the pilings above and below the line of cut. These piston-like slips prevent not only movement of the tool during the cutting operation to ensure one circumferential and continuous cut, but further, allow the tool to serve as a guide pin to ensure platform stability after the cut has been completed.

Using the method and apparatus of the present invention, all conduit including piling and conductors which are anchored to the sea floor can be cut and pinned to await removal, whether that removal be scheduled for the next day, the following week, the following month or even later. The pinning of the piling and also the abandon well conduits above and below the line of cut ensures the structural integrity of the platform so that it still retains stability in response to the hydrodynamic forces which may be exerted on it. This is so even in the case of deep water platforms where it will be necessary to cut the legs of the platforms in sections to enable a derrick barge to handle the individual sections. The lowest cut, that being the cut made at twenty feet below the mud line, would be made first and pinned. A second cutter would then be lowered to the elevation of the next to the lowest cut. That cut would then be made and the cutter would again remain in place to pin the leg together above and below the second cut. Subsequent cuts would be made with additional cutters in the same manner, still providing structural integrity and a stable work platform above the water surface.

The cutting of the piling is performed by a series of tubes radially deployed in the cutter on a common plane. Each tube is filled with what is, in essence, a solid fuel similar to thermite or magnesium. Thus, the cut is performed through the use of a series of solid fuel torches. The preferred solid fuel is Pyronol ®. Pyronol ® is manufactured by Goex, Inc. and the material itself is the subject of U.S. Pat. No. 3,695,951. Pyronol ®, once ignited, will attain temperatures between six and twelve thousand degrees Fahrenheit. These temperatures are sufficient to burn through steel and concrete.

DESCRIPTION OF THE PREFERRED EMBODIMENT

Figure 1:
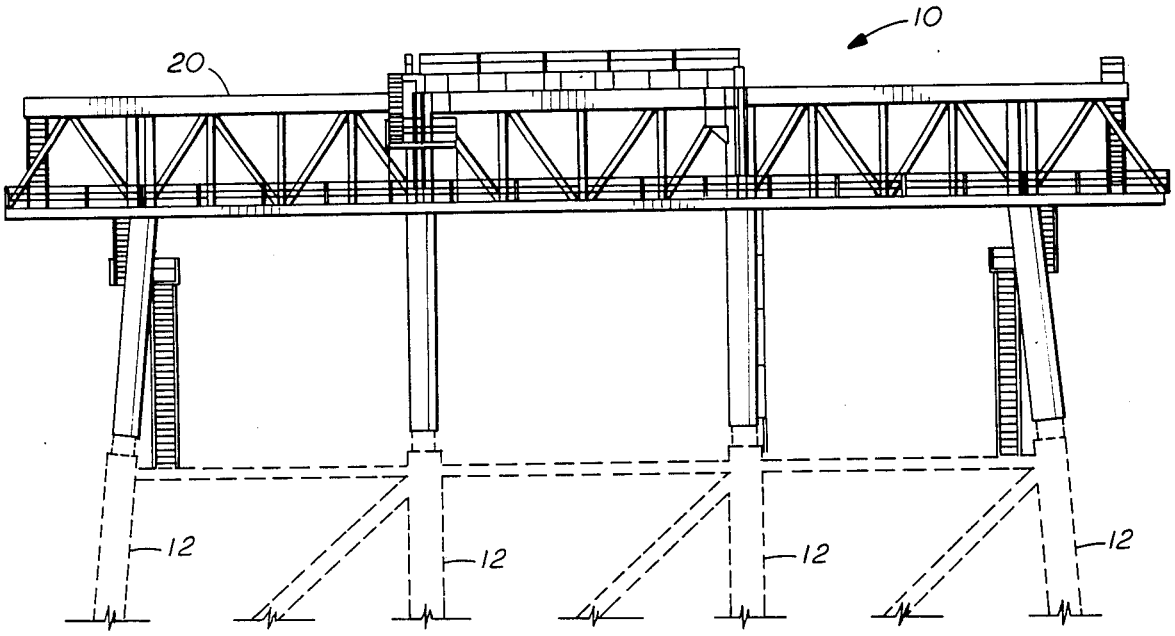
FIG. 1 is a side elevation of a typical offshore platform.

Turning first to FIG. 1, there is shown a side elevation of an eight leg offshore platform 10. Using the method and apparatus of the present invention will allow the cutting of legs 12 at a point twenty feet below the mud line without the use of explosives. Further, any abandon well conductors extending into the sea floor from the platform can similarly be cut at a point twenty feet below the mud line.

Figure 2:
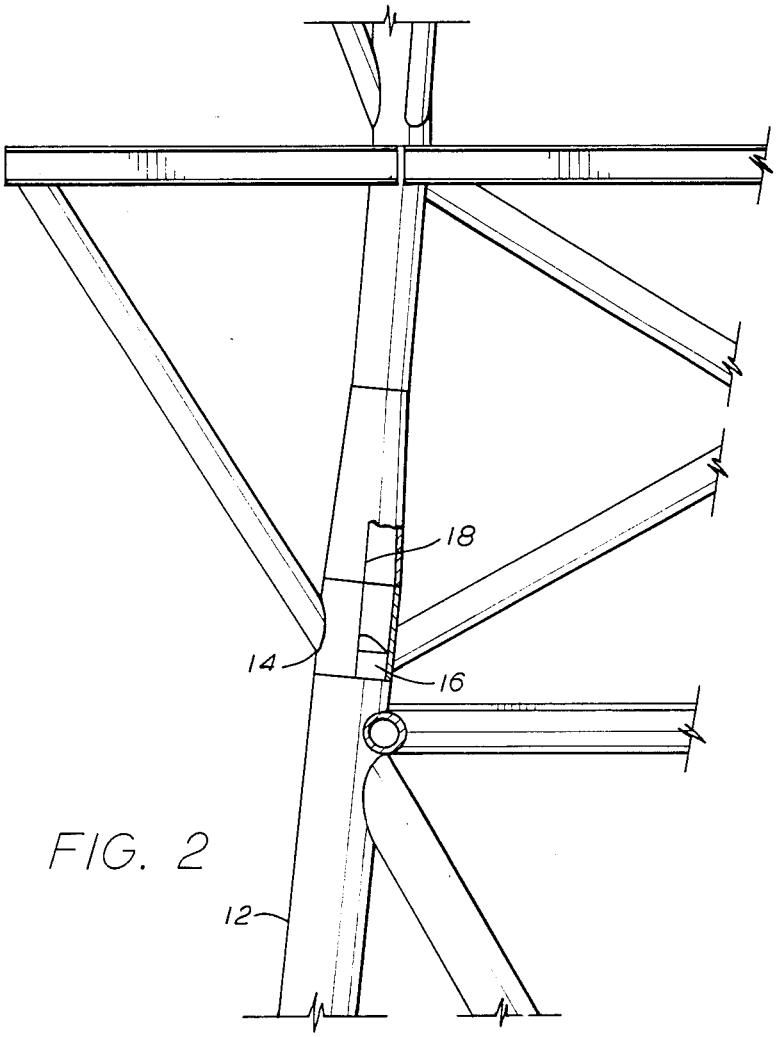
FIG. 2 is a side elevation of a pile in an offshore platform having a window cut in the location of the stabbing point.
Figure 3:
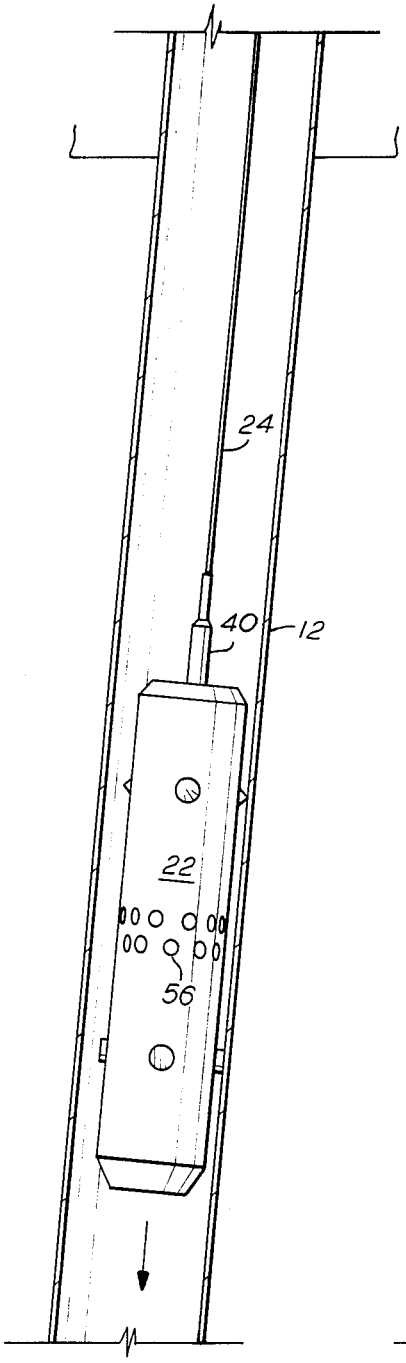
FIG. 3 is a side elevation of the apparatus of the present invention lowered to a level twenty feet below the mud line.
Figure 4:
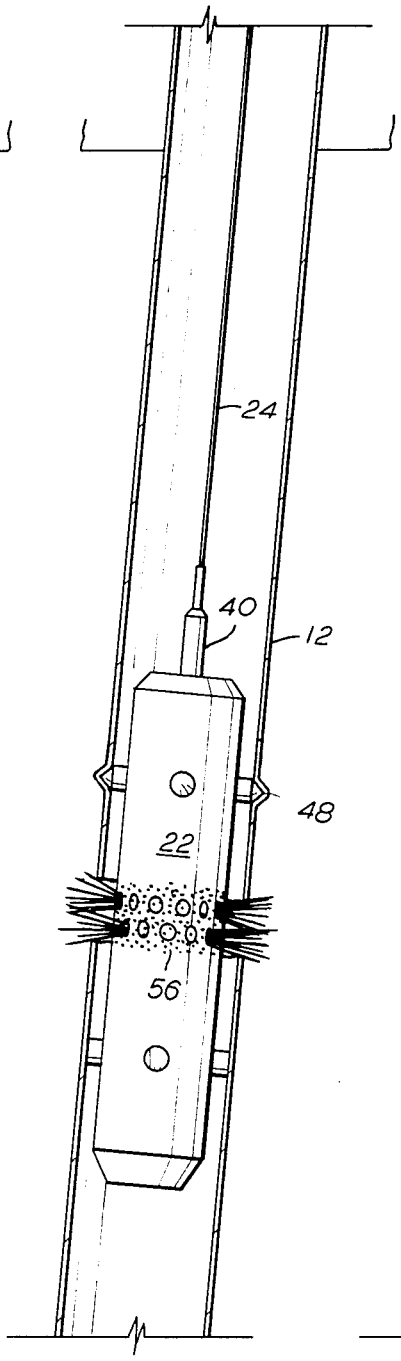
FIG. 4 is a side elevation of the apparatus of the present invention with its guide slips extended engaging the side walls of the pile with the solid fuel torches ingited.

FIG. 2 depicts the stabbing receptical 14 which is typical of the legs 12 of an offshore platform. The platform 10 is erected in stages and each leg 12 is provided with a cone 16 welded to leg 12. The cones 16 provide guides for the erection of the upper section of the platform 10, called deck section 11 which is then welded in place.

In order to practice the method of the present invention it is necessary to cut a window 18 in each leg or pile 12. The window 18 is cut in the area of the stabbing receptical 14. This allows workers to cut out the cone or any other restrictions to clear the path within the pile 12. At this point, it is necessary to cut a hole in the top of pile 12, preferrably in the location of the top deck 20, or install a lubricating tube 21 to allow easy access to the pile interior.

Once pile 12 is open at the top deck, it may be necessary to wash out pile 12 to a depth more than twenty feet below the mud line. Once pile 12 has been washed out, a gauge pass or run is made. This is accomplished by lowering a dummy tool substantially identical in diameter and length to the cutter/pinning device 22 of the present invention. The gauge pass serves to determine that there are not other restrictions within the piling which must be removed in order to be able to position the tool/cutting device 22 at the desired location twenty feet below the mud line. After the gauge pass has been made, the cutter/pinning device 22 is lowered down the piling 12 to position it to make a cut twenty feet below the mud line. The lowering of the cutter/pinning device 22 and the dummy tool used for the gauge pass is typically accomplished with a crane or an electrical winch.

Figure 5:
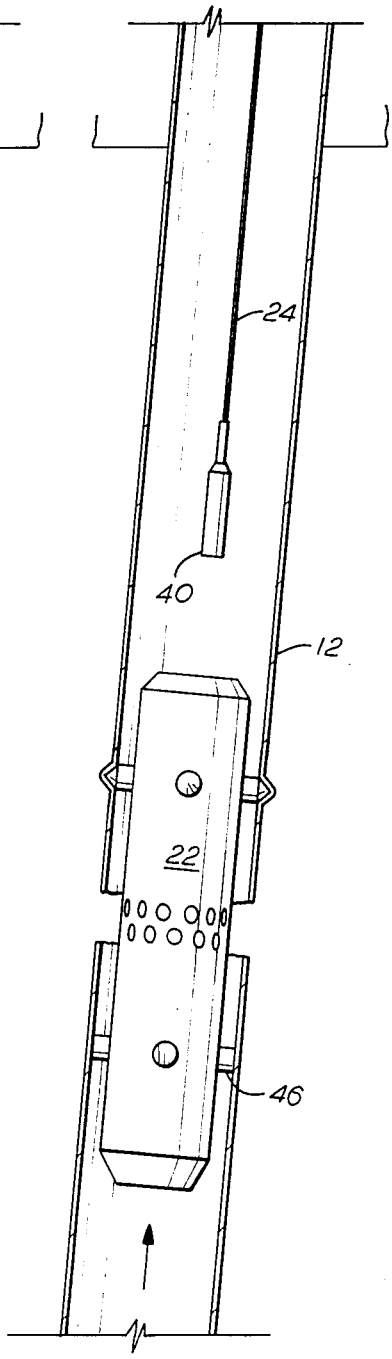
FIG. 5 is a side elevation of the apparatus of the present invention acting as a guide pin after the cut has been completed.

Once the cutter/pinning device 22 is lowered to the desired elevation, it is locked in place, preferrably both above and below the line of cut. However, it should be noted that the cutter/pinning device 22 can be designed to lock into place either above or below the line of cut as well as both above and below the line of cut. Once the cut has been made, or while the cut is being made, the support cable 24 is released from the cutter/pinning device 22 and withdrawn from pile 12 as depicted in FIG. 5. After support cable 24 has been withdrawn, the section of pile 12 removed to make window 18 is welded back in place to ensure the structural stability of the platform 10. At this point, the procedure is repeated on the next pile and so on until all of the piles 12 of the platform 10 have been cut off twenty feet below the mud line.

It should be recognized that the cutter/pinning device 22 is left behind in each pile engaging the pile 12 both above and below the line of cut to thereby serve as a pinning device preventing lateral and vertical movement of pile 12 and ensuring structural stability.

Figure 6:
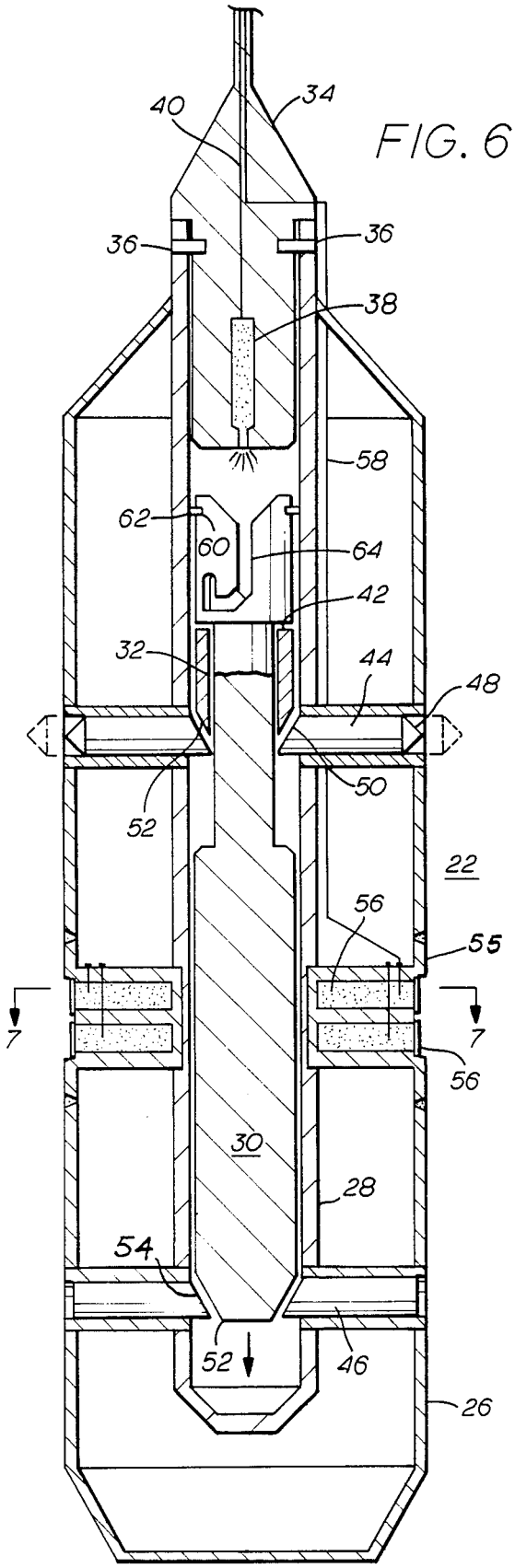
FIG. 6 is a sectional view taken along the cylindrical axis of a typical cutter/guide pinning device of the present invention.
Figure 7:
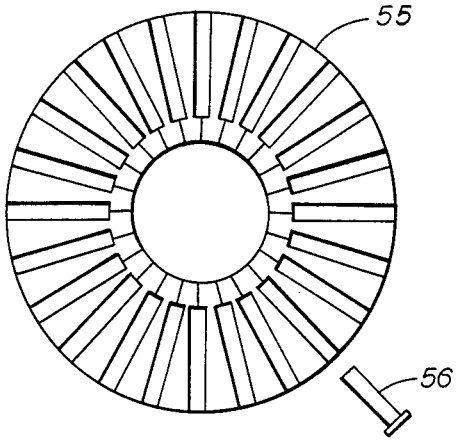
FIG. 7 is a sectional view taken along line 7—7 of FIG. 6.
Figure 8:
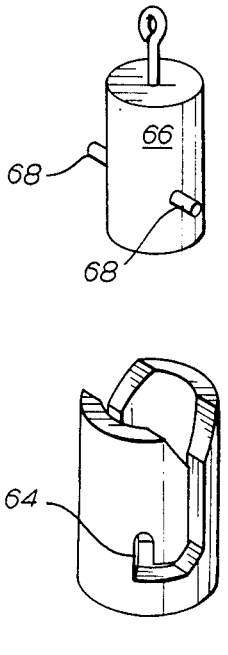
FIG. 8 is a detailed isometric view of the J-slot of the locking plunger and the means for engaging the J-slot when it is desired to withdraw the locking plunger to its original position.

As shown in FIG. 6, cutter/pinning device 22 is comprised of an outer shell 26 which is generally cylindrical. Plunger housing 28 which is also preferrably cylindrical is mounted within outer shell 26. Plunger housing 28 provides residence for plunger 30, slip driving ring 32 and cable head 34. Cable head 34 is affixed to plunger housing 28 by means of shear bolts 36. Within cable head 34 there is provided a powder charge 38 which can be ignited electrically by means of conductor 40.

Once the cutter/pinning device 22 of the present invention is lowered to the desired elevation twenty feet below the mud line of the sea floor, the powder charge 38 is ignited by means of conductor 40. The resulting explosion drives plunger 30 downward within plunger housing 28. As plunger 30 moves downward, shoulder 42 of plunger 30 drives slip driving ring 32 downward.

Disposed within outer shell 26 are upper slips or engaging pistons 44 and lower slips or engaging pistons 46. Upper slips or engaging pistons 44 and lower slips or engaging pistons 46 extend radially from plunger housing 28. There are preferrably four upper slips or engaging pistons 44 positioned at 90 degrees to one another and four lower slips or engaging pistons 46, also equally spaced radially.

Upper slips or engaging pistons 44 are cylindrical and preferrably come to a conical point 48 at the end furthest from plunger 30. The ends of upper slips or engaging pistons 44 nearest plunger 30 are cut at a slant 50 which matches the angle of taper 52 of slip driving ring 32.

The lower portion of plunger 30 is in the shape of a truncated cone. The lower slips or engaging pistons 46 extend into plunger housing 28 to abut the truncated conical end 52 of plunger 30. The inner ends 54 of lower slips or engaging pistons 46 are cut at angles such that they match the angle of slop of the truncated conical end 52 of plunger 30. As plunger 30 moves downward, slip driving ring 32 is driven downward by shoulder 42. Slip driving ring 32 causes upper slips or engaging pistons 44 to extend radially outwardly from outer shell 26 to engage the inner walls of pile 12. The conical points 48 of upper slips or engaging pistons 44 are designed to fixedly engage the walls of pile 12. In fact, the conical points 48 of upper slips 44 may be designed to deform the walls of piling 12 to thereby permanently engage such piling 12. The truncated conical end portion 52 of plunger 30 drives lower slips 46 such that they extend radially outward and also engage piling 12. The outermost ends of lower slips 46 are preferrably flat or curved to match the radius of the inside diameter of the pile. There may be serrations in the ends of lower slips 46 to provide a source of pre-adjustable friction levels. Lower slips 46 engage the piling 12 frictionally without any permanent deformation to piling 12. In such manner, upper slips or engaging pistons 44 and the lower slips or engaging pistons 46 serve a threefold purpose. First, they center the cutter/pinning device 22 within piling 12. Second, they support the cutter/pinning device 22 within the piling 12 and third, they act as a pinning mechanism after the cut is complete to prevent any relative movement at the line of cut.

Located between upper slips or engaging means 44 and lower slips or engaging means 46 is cutting means 54. Cutting means 54 is preferrably a series of solid fuel torches 56 disposed radially within outer shell 26. Each solid fuel torch 56 is, in reality, a graphite tube filled with Pyronol®. Pyronol®, once ignited, will achieve temperatures of between six and twelve thousand degrees Fahrenheit, such temperatures being sufficient to burn through steel and concrete. Depending upon the diameter and wall thickness of piling 12, it may be necessary to have two or more rings of solid fuel cutting torches 56. Solid fuel torches 56 are ignited electrically by means of conductor 58. The ignition of solid fuel cutting torches 56 may be simultaneous with the engagement of upper slips or engaging means 44 and lower slips or engaging means 46 or may be delayed after upper slips 44 and lower slips 46 have engaged pile 12.

As a result of the explosion of powder charge 38, shear bolts 36 are broken away allowing cable head 34 to separate from plunger housing 28. In such manner, cable head 34 can be withdrawn from pile 12 while cutting torches 56 are burning through piling 12 at the line of cut twenty feet below the mud line. It should be recognized that the upper portion of plunger 30 has machined therein an annular groove 60 which provides residence for seal 62. Seal 62 ensures that the explosive forces generated by the detonation of powder charge 38 do not bypass plunger 30 within plunger housing 28. Also located within the upper portion of plunger 30 is J-cut 64. J-cut 64 provides a means for withdrawing plunger 30 to its original position at the time when it is desired to remove the platform 10. At that point, it is desirable to disengage the lower slips or engaging pistons 46 from piling 12. This is accomplished by lowering pulling head 66 into piling 12. Pulling head 66 has engaging rods 68 extending therefrom. As pulling head 66 enters plunger housing 28, engaging rods 68 slide down J-slot 64. When it is attempted to withdraw pulling head 66 it becomes locked within J-slot 64 thus allowing plunger 30 to be pulled upward within plunger housing 28. As this occurs, lower slips or engaging pistons 46 are allowed to disengage from piling 12. However, slip driving ring 32 remains positioned such that upper slips or engaging pistons 44 continue to engage piling 12. At that point, the deck section 11 is removed by cutting the piles 12 at the plus-12 level and lifting it away with a derrick barge. Before or after the deck section is removed the cutter/pinning device 22 is mechanically unlocked as described above. Alternatively, the remaining portion of the platform 10 can be lifted vertically thereby sliding lower slips or engaging pistons 46 out of those portions of piles 12 more than twenty feet below the mud line, since lower slips 46 engage piles 12 frictionally only.

The method of the present invention allows the jacket and top deck of the platform 10 to be left intact which is beneficial because this in turn allows all of the navigational aids of the platform to remain in place and in functional order. In other words, the top deck has remained in place and after the windows 18 have been welded back in place, every step of the method can be practiced from the top deck.

When all of the pilings 12 have been cut, the platform 10 remains structurally stable because each piling is still pinned. In such manner, the platform 10 can remain in place until some time later when the derrick barge is available to come and haul the platform off or until a time when more than one structure can be made ready for lifting. This is particularly advantageous should a storm come up in the middle of the cutting or removal operations. It should be recognized that the method of the present invention allows multiple platforms to be readied for removal while requiring the mobilization of only a single derrick barge.

It should be apparent that the cutting/pinning device 22 of the present invention must be sized according to the diameter of the piling. Similarly, it can be sized to be placed within conductor piping to achieve similar results in cutting off such conductor piping twenty feet below the mud line or in sections.

Using the method of the present invention, the platform can be removed in one or multiple stages. In other words, the platform 10 can be cut in as many pieces as required depending principally on the weight and water depth as well as the handling capacity of the derrick barge. If the platform 10 is to be hauled away in pieces, it is only necessary to release the pinning mechanism of the cutter/pinning device 22 within the pilings 12 which are to be removed with that particular piece of the platform 10. Further, with deep rigs, pilings 12 can be cut in stages, cutting the lowest point twenty feet below the mud line first and leaving the cutter/pinning device 22 in place. Then, a second cutter/pinning device 22 is lowered into the same piling to make the next cut at the second lowest desired elevation. This process can be repeated to cut the pilings 12 of the platform 10 in as many pieces as is required. It should be understood that when making multiple cuts in piles 12 you lose your working platform with the first lift. Therefore, the cutter/pinning devices 22 must be released mechanically by divers or by lifting with sufficient force to overcome the frictional engagement of lower slips 46 after the first lift is made.

It should be recognized that the method of the present invention could be practiced by a cutter/pinning device which does not rely on solid fuel cutters. Rather, the cut could be made mechanically or perhaps, by use of a high pressure water cutter or high pressure sand/water cutter.

From the foregoing, it will be seen that this invention is one well adapted to attain all of the ends and objects hereinabove set forth, together with other advantages which are obvious and which are inherent to the apparatus and method.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A method for cutting piling and conductors extending into the sea floor from an offshore platform comprising the steps of:

a. inserting a solid fuel cutter/pinning device into the piling or conductor to be cut, said solid fuel cutting/pinning device having means for engaging the piling or conductor;

b. lowering said solid fuel cutting/pinning device to a desired elevation;

c. fixing the position of said solid fuel cutter with said engaging means;

d. igniting the solid fuel cutting/pinning device to thereby burn through the piling or conductor;

e. maintaining the piling or conductor in substantially aligned and supported position after the piling or conductor has been cut so that the offshore platform remains structurally stable.

2. A method for cutting piling and conductors extending into the sea floor from an offshore platform comprising the steps of:

a. lowering a cutter/pinning device with a support cable through a piling or conductor to a desired elevation of cut;

b. engaging the conductor or piling in close proximity to an elevation of cut above and below the elevation of cut;

c. cutting the piling or conductor;

d. maintaining the piling or conductor in substantially aligned and supported position after the piling or conductor has been cut so that the offshore platform remains structurally stable.

3. A method for cutting piling and conductors extending into the sea floor from an offshore platform as recited in claim 2 further comprising the step of:

withdrawing the support cable from the piling or conductor leaving the cutter/pinning device within the piling or conductor.

4. A method for cutting piling and conductors extending into the sea floor from an offshore platform as recited in claim 3 further comprising the step of:

disengaging the conductor or piling below the elevation of cut after the cutting step has been completed.

5. A method for cutting piling and conductors extending into the sea floor from an offshore platform as recited in claim 2, wherein:

said cutting step is performed with a plurality of solid fuel cutting torches.

6. A method for cutting piling and conductors extending into the sea floor from an offshore platform as recited in claim 2, wherein:

said engaging step includes driving pistons radially from the cutter/pinning device to extend into the walls of the piling or conductor.

7. A method for cutting piling and conductors extending into the sea floor from an offshore platform comprising the steps of:

a. positioning a cutter/pinning device within a piling or conductor at a desired elevation of the cut;

b. engaging and deforming the piling or conductor above the desired elevation of cut with pistons extending radially from the cutter/pinning device;

c. cutting the piling or conductor;

d. maintaining the piling or conductor in substantially aligned and supported position after the piling or conductor has been cut so that the offshore platform remains structurally stable.

8. An apparatus for cutting piling and conductors extending into the sea floor from an offshore platform comprising:

a. a substantially cylindrical shell;

b. upper engaging means extendable from said substantially cylindrical shell to affix said substantially cylindrical shell to the piling or conductor;

c. lower engaging means extending from said substantially cylindrical shell to affix said substantially cylindrical shell to said piling or conductor, said upper and lower engaging means and said substantially cylindrical shell forming a stabilizing means for maintaining the piling or conductor in substantially erected position after cutting of the piling or conductor has been completed;

d. cutting means mounted within the substantially cylindrical shell between said upper engaging means and said lower engaging means.

9. An apparatus for cutting piling and conductors extending into the sea floor from an offshore platform as recited in claim 8 wherein:

said engaging means are a plurality of pistons radially disposed in said substantially cylindrical shell.

10. An apparatus for cutting piling and conductors extending into the sea floor from an offshore platform as recited in claim 8 wherein:

said cutting means is a plurality of solid fuel cutting torches radially disposed in said substantially cylindrical shell.

11. An apparatus for cutting piling and conductors extending into the sea floor from an offshore platform as recited in claim 10 further comprising:

means for igniting said plurality of solid fuel cutting torches.

12. An apparatus for cutting piling and conductors extending into the sea floor from an offshore platform as recited in claim 8 further comprising:

a support cable for lowering said substantially cylindrical shell into the piling or conductor, said support cable being removable from said substantially cylindrical body after said engaging means have engaged the piling or conductor.

* * * * *